US008272506B1

(12) United States Patent
Flannery et al.

(10) Patent No.: US 8,272,506 B1
(45) Date of Patent: Sep. 25, 2012

(54) DRINKING VESSEL HOLDING DEVICE

(76) Inventors: Neil M. Flannery, Mantoloking, NJ (US); Thomas A. Flannery, Holmdel, NJ (US)

( * ) Notice: Subject to any disclaimer, the term of this patent is extended or adjusted under 35 U.S.C. 154(b) by 684 days.

(21) Appl. No.: 11/159,068

(22) Filed: Jun. 22, 2005

(51) Int. Cl.

| | |
|---|---|
| ***B65D 77/00*** | (2006.01) |
| ***B65D 21/02*** | (2006.01) |
| ***A47G 19/22*** | (2006.01) |
| ***A47B 73/00*** | (2006.01) |
| ***A45F 5/10*** | (2006.01) |

(52) U.S. Cl. ..... 206/217; 220/23.4; 220/23.83; 220/711; 220/737; 211/74; 294/159

(58) Field of Classification Search ..... 220/737, 220/711, 729, 735, 754, 757, 759, 23.4, 23.83; 206/150, 139, 427, 217; 294/159–163; 211/74; D06/567

See application file for complete search history.

(56) References Cited

U.S. PATENT DOCUMENTS

| | | | | |
|---|---|---|---|---|
| D34,918 | S | 8/1901 | Wheeler | |
| 2,057,972 | A * | 10/1936 | Pieck | 47/71 |
| 2,460,915 | A * | 2/1949 | Allen | 220/759 |
| 2,558,645 | A | 6/1951 | Docter | |
| 2,821,307 | A | 1/1958 | Linsley | |
| 3,131,829 | A * | 5/1964 | Masser | 206/144 |
| D206,943 | S | 2/1967 | Kinney | |
| D218,350 | S | 8/1970 | Marks | |
| 4,170,082 | A * | 10/1979 | Freedman | 446/109 |
| 4,699,318 | A | 10/1987 | Donatello et al. | |
| 4,940,137 | A * | 7/1990 | Straub | 206/139 |
| 4,955,503 | A | 9/1990 | Propes | |
| 5,025,936 | A * | 6/1991 | Lamoureaux | 211/74 |
| 5,071,042 | A * | 12/1991 | Esposito | 222/570 |
| 5,160,087 | A | 11/1992 | Mandell | |
| 5,165,583 | A * | 11/1992 | Kouwenberg | 224/148.3 |
| 5,273,182 | A * | 12/1993 | Laybourne | 220/740 |
| D371,720 | S * | 7/1996 | Hung | D7/513 |
| 5,722,574 | A * | 3/1998 | Pratt | 224/148.4 |
| 5,899,515 | A * | 5/1999 | Burns | 294/159 |
| 5,934,501 | A | 8/1999 | Wright et al. | |
| 6,029,845 | A | 2/2000 | Mueller | |
| 6,145,905 | A * | 11/2000 | Carpenito | 294/159 |
| 6,446,460 | B1 | 9/2002 | Rosenberg | |
| 6,533,148 | B1 * | 3/2003 | Dahl | 224/148.6 |
| D472,426 | S | 4/2003 | Premji | |

(Continued)

FOREIGN PATENT DOCUMENTS

| | | |
|---|---|---|
| GB | 2293750 | 10/1996 |

OTHER PUBLICATIONS www.skitini.com.

*Primary Examiner* — Bryon Gehman
*Assistant Examiner* — Shawn Braden
(74) *Attorney, Agent, or Firm* — Charles A. Wilkinson; Clinton H. Wilkinson

(57) ABSTRACT

A novelty device for securing two or more drinking vessels to an elongated body member to facilitate simultaneous beverage consumption by two or more participants is provided, the device including threaded knob or socket means for securing the drinking vessels to the body member, and a means for securing two or more of such holding devices together so as to increase the number of potential participants, plus the device also serving as a novel medium for placement of advertising indicia.

16 Claims, 4 Drawing Sheets

U.S. PATENT DOCUMENTS 6,596,374 B1 7/2003 Adjeleian
6,604,648 B2 * 8/2003 Immerman et al. ..... 220/630
6,631,812 B2 * 10/2003 Ruiz ..... 211/85.29
6,964,443 B1 * 11/2005 Newton ..... 294/172
7,048,130 B2 * 5/2006 Hurst ..... 211/74
7,325,807 B1 * 2/2008 Eason ..... 273/342
D573,421 S * 7/2008 Pittsinger ..... D7/701
2004/0173649 A1 * 9/2004 Luedtke ..... 224/258
2005/0081981 A1 * 4/2005 Heikkila ..... 156/109

* cited by examiner

DRINKING VESSEL HOLDING DEVICE

BACKGROUND OF THE INVENTION

1. Field of the Invention

The present invention is related to devices for holding, drinking vessels and containers as well as to novelty devices, and more particularly to a novelty drinking vessel holding device which facilitates simultaneous consumption of drinks or beverages by two or more individuals in a festive manner.

2. Preliminary Discussion

A variety of foods and beverages may be provided at many if not most social events and gatherings, and often serve as an important part of the festivities. For example, typical foods may range from, depending upon the type of event, grilled items such as hamburgers and hot dogs, finger foods, hors d'oeuveres and the like, or full course meals, while typical beverages include soft drinks, wine, beer, mixed alcoholic drinks, cocktails, as well as alcohol shots. Consumption of alcoholic beverages is common, of course, at both private parties and gatherings as well as at bars, inns, taverns, and nightclubs. For some groups, particularly those in their 20s and early 30s and including college students, beer is the drink of choice, and various simplistic beer drinking social games have been developed, such as to race or consume cups or even larger containers of such beverage as quickly as possible, with the person finishing such drink the fastest being declared the winner. At other usually more formal events, wine or shots containing alcohol are routinely consumed by several individuals in unison as a toast or celebratory symbol, either to commemorate the occurrence of a significant event, or merely as part of the festivities. While traditions vary greatly depending on the country or culture, in many cultures consumption of shots of alcohol or other drinks by multiple persons altogether is seen as a bonding event between such persons, and in fact, those persons who are present at such bonding event and choose not to participate are often, at least temporarily, seen as not being "team players", and such person or persons commitment to a group cause or the like therefore may be questioned.

While there are, as a result, numerous possible circumstances where drinks, cocktails, or other beverages may be consumed simultaneously by two or more persons, in most of such situations each participant will hold his or her own individual glass, cup, or other drinking vessel and then, usually upon some explicit or implicit signal, will altogether commence consumption of the contents of such vessels. The present inventor, however, has now conceived of an improved holding device for such individual vessels that can be used at virtually any social gathering or event, wherein upon the occurrence of a simultaneous drinking moment, each drinking vessel is first secured to such holding device and filled with a drink, and then the participants will lift the drinking vessel holder and consume their drinks in unison. As illustrated in the following review of the prior art, although previous attempts have been made to devise multiple beverage holders, the present invention incorporates features not found in or taught by any combination of such previous arrangements, and the present inventor further believes that such features make the present invention safer, easier, and more desirable to use and attractive than any of such previous arrangements. The present inventor's novel holding device not only facilitates simultaneous toasting or beverage consumption, but also even further increases the bonding or social nature of an event by encouraging the participants to physically interact and work together by balancing and holding a single device, thereby increasing the significance and memorableness of the event both in the minds of the participants as well as onlookers.

3. Description of Related Art

The patented prior art with respect to devices for facilitating simultaneous consumption of a beverage by two or more persons for celebratory or other purposes evidences numerous double-cup arrangements and vessel holders. The most relevant of such prior art references known to the present inventor are disclosed and discussed below.

U.S. Pat. No. 2,558,645 issued to E. W. D. Docter on Jun. 26, 1951, entitled "Beverage Sipper", discloses a device for enabling several persons to sip from a single beverage vessel simultaneously. The Docter device is secured in the bottom of a beverage container or bowl by a suction cup, and is comprised of a cylindrical straw holder having multiple individual straws. Such device, wherein multiple persons drink from the same container simultaneously, may be objectionable to some as being unsanitary, while the present invention facilitates concurrent drinking from separate or different containers.

U.S. Pat. No. 2,821,307 issued to D. L. Linsley on Jan. 28, 1958, entitled "Holder for Fuses and Other Articles", discloses a molded plastic holder for holding multiple related objects such as electrical fuses including a series of longitudinally spaced-apart cupped sockets in which such objects are placed and held. While the Linsley holder is structurally somewhat similar to one embodiment of the present invention, it is not indicated as possibly being used as a holder provided for simultaneous consumption of beverages such as the coordinated activities facilitated by the present invention, and furthermore it would not be obvious to use it in such a manner.

U.S. Pat. No. 4,699,318 issued to M. A. Donatello et al. on Oct. 13, 1987, entitled "Drinking Apparatus", discloses another device for enabling multiple persons to drink from the same container simultaneously. Such device is comprised of a circular base member having several tubes connected to spaced apart nipples. The device is placed in the bottom of a pitcher with the tubes extending upwardly out of the pitcher, so that each user simply places his or her mouth over the upper end of one of the tubes and creates a suction so that the beverage is drawn through the tubes into their mouths: A check valve is provided on each tube so that fluid can flow in a single direction. While the Donatello invention appears to be more sanitary than the Docter simultaneous sipper discussed above, such invention is structurally very different from the present invention, in which individual beverage containers or vessels are held together.

U.S. Pat. No. 4,955,503 issued to M. L. Propes on Sep. 11, 1990, entitled "Partitioned Drinking Cup", discloses a cup that is divided into two separate drink or beverage containing compartments, each having its own straw, and the cup being provided with separate handles. While the Propes cup enables two persons to drink from beverages stored in separate compartments, the Propes cup is otherwise dissimilar to the present invention, which is not a cup but a multiple beverage vessel holder.

U.S. Pat. No. 5,150,087 issued to G. D. Mandell on Nov. 3, 1992, entitled "Drinking Straw", discloses a straw having a single tubular inlet with a chamber situated on its upper end, with at least two drinking outlets connected to such tubular inlet leading out of the chamber. While such device is unique in that it enables two or more persons to drink simultaneously from the same container, and it is difficult for one person to drink from his or her straw alone, as this would cause the straw to become an "open system" and reduce the suction on the straw, nevertheless such arrangement is not similar to the present invention.

U.S. Pat. No. 5,934,501 issued to G. Wright et al. on Aug. 10, 1999, entitled "Beverage Container for Use with Drinking Cup", discloses a container which when inserted into a drinking cup divides the cup into at least two separate liquid holding compartments. While two persons presumably could drink from the separate containers simultaneously, the primary purpose of such invention appears to be to enable a single person to store two separate drinks or drink flavors in a single container.

U.S. Pat. No. 6,029,845 issued to M. A. Mueller on Feb. 29, 2000, entitled "Floating Beverage Holder", discloses a holder for a plurality of beverage cups wherein the cups are secured in cavities or pockets in the holder, and which holder floats. The round shape of the Mueller holder is not conducive to simultaneous drinking from vessels stored in such holder, as the holder could not be tilted in any single direction that would allow such simultaneous beverage consumption.

U.S. Pat. No. 6,446,460 issued to N. Rosenberg on Sep. 10, 2002, entitled "Method of Chilling and Consuming an Alcoholic Beverage and Apparatus Therefor", discloses an insulated container for receiving lidded shot glasses having a base and removable cover. The container is placed in the freezer to chill the alcohol until it is desired to be consumed. Rosenberg indicates that by not having to move the chilled alcohol into a non-chilled glass for drinking, a better chilled and therefore better tasting drink or shot results. While Rosenberg therefore discloses a container for holding multiple shot glasses, such container clearly is not meant to be used in the same manner as the present invention.

U.S. Pat. No. 6,596,374 issued to M. J. Adjeleian on Jul. 22, 2003, entitled "Device for Securing Objects", discloses a partial vacuum means for securing objects of different types to a surface. While apparently primarily for holding multiple beverage containers to a moving surface and still allowing the beverages to be lifted out of the holder and sipped whenever desired, such device does not facilitate simultaneous beverage consumption in a manner similar to the present invention.

The inventor is also aware of several design patents directed to double cup arrangements. U.S. DESIGN Pat. No. 34,918 issued to H. L. Wheeler on Aug. 13, 1901, entitled "Cup", discloses a drinking vessel having twin cup sections joined by an intermediate fluted section. U.S. DESIGN Pat. No. 206,943 issued to J. Kinney on Feb. 14, 1967, entitled "Double Martini Glass", discloses an ornamental design for a martini glass having a single base and a pair of stems supporting separate liquid holding vessels. U.S. DESIGN Pat. No. 218,350 issued to R. P. Marks on Aug. 11, 1970, entitled "Novelty Drinking Vessel", discloses an ornamental design for a vessel comprised of a pair of mugs joined together by a rod or tube. U.S. DESIGN Pat. No. issued to A. Premji on Apr. 1, 2003, entitled "Cup", discloses an ornamental design for a drinking vessel having the appearance of two cups that are joined together along one wall to form a single vessel. Of such designs, only the Marks design appears to be possibly for use in the manner similar to the present invention, and such drinking vessel is structurally dissimilar to the present inventor's holder.

U. K. PAT. NO. GB 2,293,750 issued to H. Hung and published on Oct. 4, 1996, entitled "A Double-Cup Drinking Vessel", discloses a drinking vessel designed such that two persons can drink from the container at the same time. The middle area of the cup between the two drinking bowls includes a recess wherein liquid poured in such recess will flow into both bowls. While Hung also therefore teaches a double drinking vessel, it does not show a holding device for separate drinking vessels whereby double or simultaneous drinking can occur.

The present inventor is aware that one or more others have developed crude or homemade beverage vessel holding devices wherein two or more disposable plastic drinking cups were secured to a board member such that when the board was held by two or more persons and tipped toward such persons, the contents of the cups could be consumed simultaneously. In addition, at the web address www.skitini.com, there is shown an old ski having several martini glasses permanently secured thereto. While such devices are broadly used in the same manner as the present inventor's holding device, the present inventor has through extensive experimentation and design efforts devised numerous improvements not present in or anticipated by any such other arrangements. While each of the prior art references discussed above are each suitable for their particular purposes, none of such references discloses a holding device which facilitates simultaneous beverage consumption by multiple persons wherein each person drinks from his or her own separate drink vessel, but wherein all of which vessels have been preferably temporarily but securely affixed to the holding device, and wherein two or more of the holding devices may be secured together end-to-end in order to further increase the number of participants in such simultaneous drinking event. In addition, the inventor has also discovered that the surface area of the holding device is extremely useful as an advertising device, and that the holder can be decorated or provided in a virtually unlimited number of colors or designs and may include whatever advertising indicia on its surface as may be desired.

OBJECTS OF THE INVENTION

It is therefore a primary object of the present invention to provide a device primarily for holding two or more drinking vessels to facilitate simultaneous drinking activities wherein multiple persons may consume their drinks in unison.

It is a further object of the present invention to provide a novelty holding device for one or more drinking vessels comprised of an elongated body member to which such drinking vessels may be independently affixed, whereby in use when such vessels are secured to the body member and filled with a beverage, the body member is by each participant and tipped so that the beverages may be consumed in unison.

It is a still further object of the present invention to provide a novelty beverage vessel holding device wherein in one embodiment such beverage vessels are threadably secured in spaced-apart internally threaded sockets on the upper surface of the elongated body member.

It is a still further object of the present invention to provide a novelty beverage vessel holding device wherein in another embodiment two or more externally threaded knobs are provided on the upper surface of the elongated body member, to which knobs said beverage containing vessels are threadably secured.

It is a still further object of the present invention to provide novelty beverage vessel holding device whereby such devices may be temporarily secured together in an end-to-end relationship, thereby increasing the number of possible participants who can take part in a single simultaneous beverage consumption event.

It is a still further object of the present invention to provide a beverage vessel holding device whereby several of such devices may be secured together in an end-to-end relationship via a buckle or clip means provided on the ends of each of the holding devices, or alternatively via a mortise and tenon connection arrangement.

It's is a still further object of the present invention to provide a novel advertising medium in the form of such beverage vessel holding devices, on which various logos, designs, trademarks, or the like can be applied for advertising and promotional purposes.

It is still further object of the present invention to provide a beverage vessel holding device made of PCV plastic that is inexpensive to manufacture, attractive, simple to use, and which may be provided in various colors, color combinations, designs, and shapes, and which may also be used to hold nonliquid foodstuffs if desired.

If is a still further object of the present invention to provide a beverage vessel holding device wherein one or more of the lip of each of the beverage vessels, the threaded sockets, and the buckles or clips used to connect two or more of such devices together in an end-to-end relationship may be coated with a resilient material.

Still other objects and advantages of the invention will become clear upon review of the following detailed description in conjunction with the appended drawings.

SUMMARY OF THE INVENTION

The present invention is directed to a drinking vessel holding or support device primarily of a novelty type and being comprised essentially of an elongated beam or body member made out of wood, plastic, metal, or other suitable material or combination of materials, to which two or more individual drinking vessels are temporarily securable. When connected to the holding device the drinking vessels are spaced apart so that two or more persons positioned side-by-side can comfortably lift and simultaneously manually support the device and drink from such vessels in unison. More particularly, after the drinking vessels are secured to the holder and filled with a liquid to be consumed, the participants, who are positioned all on the same side of the holder adjacent their own drinking vessel, will in unison lift the holder so that the vessels are positioned adjacent their mouths, and then, usually upon the occurrence of some signal, will all commence tipping the holder towards them in a coordinated manner, simultaneously consuming the contents of the vessel. The drinking vessels may be secured to the holding device in any suitable manner, although in a preferred arrangement the vessels are secured in spaced apart sockets provided on the upper surface of each holder via matching threads provided in the sockets and on the outer walls of the drinking vessels. In another preferred arrangement, externally threaded knobs may be provided on the upper surface of the holding device, with the drinking vessels again having a socket with matching threads, while in other embodiments the vessels may be connected to the holding device via a hook-and-loop fastener arrangement, straps, magnets, suction cups, bevels, or O-rings. Each holding device also includes a means for connecting two or more of such devices together in an end-to-end relationship, such as through the use of spring clips or buckles secured on the ends of each device. The holding devices may also be provided in any number of colors or designs, and in another embodiment advertising indicia is strategically placed on the outer surface of each device, thereby enabling the holders to also serve as a novel advertising medium, in addition to being used as a drinking vessel holding device. While it is thought that the device will be primarily used for holding drinking vessels, other containers for holding solid food items may also be used with the device. The holding device may also be arranged with the drinking vessels permanently or integrally connected, so that rather removing the vessels after use, the entire device may be washed and then reused. The outer surface of the device itself may also include a cushion means to increase its attractiveness and also to serve as a safety feature, and the rim of the drinking glasses, threaded connections, and means for connection the holding devices together may also be coated with a resilient material.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Reference will now be made in detail to a presently preferred embodiment of the invention as illustrated in the accompanying drawings. Whenever possible, the same reference numbers will be used throughout the drawings to refer to the same or like parts.

Figure 1:
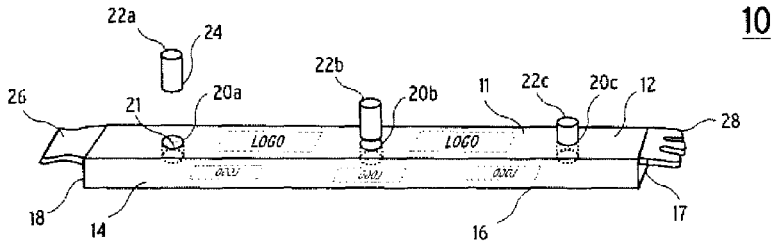
FIG. 1 is a perspective view from the front of a preferred embodiment of the drinking vessel holding device of the present invention.

FIG. 1 is a perspective view from the top of one of the holding devices 10 of the invention. Holding device 10 is comprised of a beam or holding member 11 having a top surface 12, side surfaces 14 and 15 (not visible) which depend downwardly from the opposite side edges of top surface 12, a bottom surface 16 extending between the lower edges of side surfaces 14 and 15 (see FIG. 7), and end surfaces 17 and 18. Holding member 11 is preferably formed from either wood or PVC plastic; however, it should be appreciated that other suitable materials including, but not limited to, light metal, cardboard, and hard foam plastic may also be advantageously utilized. Although not shown, if desired, one or more of the outer surfaces of the device may be covered with a material such as paper, vinyl, foam or other cushioning means, or the like.

Figure 2:
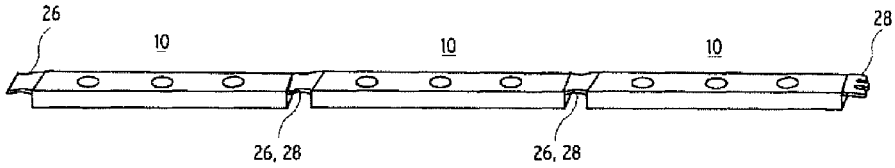
FIG. 2 is a perspective view of several of such drinking vessel holding devices secured together.

Since the primary purpose of holding device 10 is for attachment of one or more drinking vessels to such device to facilitate simultaneous beverage consumption by two or more participants holding such device, provision for connecting at least two drinking vessels to such device 10 is preferred. However, since, as shown in FIG. 2 and described below, the holders may be connected together in an end-to-end relationship to further increase the number of participants, it would be possible in an alternative arrangement for a single drinking vessel to be attached to each connected-together holder, with the number of holders equaling the number of participants. In the embodiment shown in FIGS. 1 and 2, member 11 is shown having spaced apart sockets 20*a*, 20*b*, and 20*c* formed in top surface 12. The side walls of sockets 20*a*, 20*b*, and 20*c* contain threads 21 for receiving drinking vessels 22*a*, 22*b*, and 22*c* having matching threads 24 on an outer surface of the base portions of such vessels. Drinking vessels 22*a*, 22*b*, and 22*c* may be shot glasses, small or regular size glasses such as sixteen ounce or twenty four ounce beer glasses or mugs, plastic molded cups, or any other drinking vessel that might be specifically adapted for use with holding device 10. Vessels 22*a*-22*c* are secured to member 11 by placing such vessels in sockets 20*a*-2*c*, respectively, and then twisting the vessels so that the threads in the sockets and on the vessels become interlocked. Preferably, only a half-turn to a full turn will be required to interlock the threads snugly. The step of securing the drinking vessels to member 11 may take place either before of after such vessels are filled with a drink to be consumed. In FIG. 1, vessel 22*a* is shown positioned above socket 20*a* in member 11, vessel 22*b* is about to be secured in socket 20*b*, and vessel 22*c* is secured in socket 20*c*.

Also connected extending outwardly from the side edges 17 and 18 of member 11, in substantially the same plane as the body member 11 of device 10, are male and female clip or buckle members 26 and 28, respectively. Clips or buckle members 26 and 28 may either be secured snugly to body member 11 by screws or the like, or may be molded integrally with the body member 11. As shown in FIG. 2, buckle members 26 and 28 are used to connect multiple holding devices 10 together in an end-to-end relationship. Thus, in FIG. 2, three of the devices 10 have been temporarily connected together by buckles 26-28, thereby increasing the number of possible beverage vessels that can be attached, and therefore the number of possible participants in a simultaneous beverage consumption event, from three to nine. A greater or lesser number of devices 10 may be connected together in a like manner. Buckle members 26 and 28 provide a rigid connection between the body members 11 of each holding device 10*a*, 10*b*, and 10*c* in FIG. 2, in that when connected they preferably have the appearance and feeling of being comprised of a single or unitary rigid member, rather than several individual members connected together.

Figure 3:
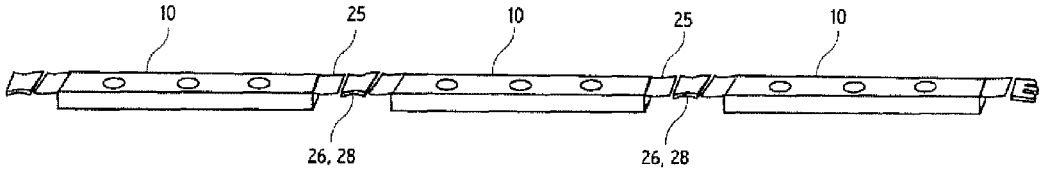
FIG. 3 is a perspective view of an alternative embodiment of the invention.

In FIG. 3, an alternative embodiment of the invention is shown wherein buckle members 26 and 28 are connected to the side edges 17 and 18 of each body member 11 by flexible straps 25. The use of flexible straps 25 may be preferred in some circumstances over the rigid connection shown and illustrated with reference to FIG. 2 in that there a greater opportunity for the users to better control or maneuver the individual devices 10*a*, 10*b*, and 10*c* separately, thereby increasing the comfort of using such devices and reducing the possibility and likelihood of spills occurring during use. As with the previous embodiment, instead of each device holding or supporting three drinking vessels, a single drinking vessel could be secured to each of such devices, which arrangement in combination with the use of straps 25 would give each individual user slightly more control over his or her particular beverage vessel holding device, even further reducing the chances of a spill or other inadvertent movement of the members occurring. Of course, others may prefer the rigid connection between the body members that results from the arrangement of FIG. 2, particularly where the risk of spilling a drink is considered part of the challenge and fun of using such device.

Figure 4:
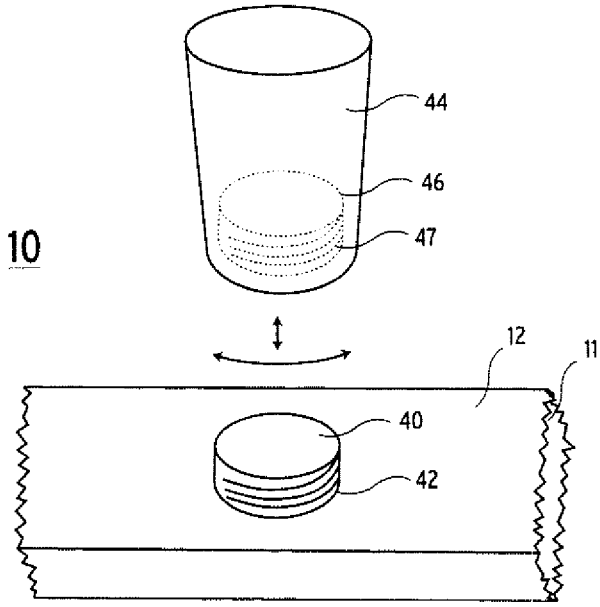
FIG. 4 is a partial view of the drinking vessel holding device illustrating a preferred means means for detachably connecting a drinking vessel to such device.
Figure 5:
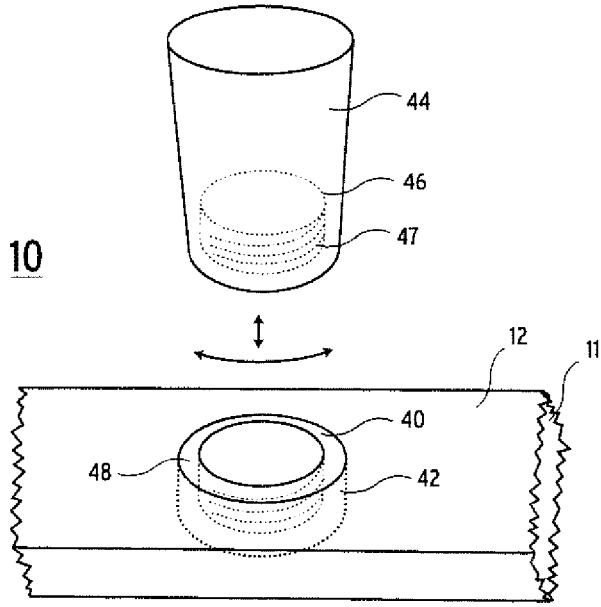
FIG. 5 is a partial view of a portion of the drinking vessel holding device illustrating an alternative alternative means for detachably connecting a drinking vessel to such device.

FIG. 4 is a partially broken away view of another preferred embodiment of the holding device 10 of the invention. Unlike the embodiments shown in FIGS. 1-3, in which sockets 20*a*-*c* are provided in top surface 12 of body member 11, in FIG. 4 such sockets have been replaced by knobs or cylindrical extensions 40 extending upwardly from top surface 12, with such knobs or extensions 40 having threads 42 on their exterior surface. Knobs 40 may either be attached directly to the top surface 12 of body member 11 such as by screws or in another usual manner, or integrally formed or molded with body member 11. In addition, each drinking vessel 44 is provided with a matching socket or cylindrical concavity 46, shown in dotted lines, having threads 47 on the side walls of such socket or concavity 46 matching threads 42 on knob 40, the socket 46 being open from the bottom of vessel 44. To attach vessel 44 to body member 11, first the vessel is positioned with socket 46 over knob or cylindrical extension 40, and then is pushed downwardly onto the knob and twisted so that threads 42 on knob 40 engage with threads 47 in socket 46 of vessel 44. Preferably, the threads will be arranged so that only a half-turn up to a full turn will be required to secure the vessel in place. FIG. 5 illustrates another alternative embodiment of the invention, which embodiment is similar to the embodiment shown in FIG. 4, except knob or cylindrical extension 40 is recessed at least partially in a shallow chamber or depression 48 in top surface 12 of body member 11. Vessel 44 is secured on recessed knob in the same manner as described with reference to FIG. 4. It should be evident that the embodiments shown in FIGS. 4 and 5 are constructed so that multiple drinking vessels can be quickly and simply connected and disconnected from the holding device 10 on the threads in a similar manner, thereby facilitating the ease of use of the present invention.

While the drinking vessels have been described above as being detachably connected to the holding device 10 via pairs of matching threads on the body member and the drinking vessels, it should be evident to one skilled in the art that there may be other equally effective arrangements for attaching such drinking vessels to the body member, such as, for example, through the use of hook-and-loop fasteners on the top surface of the holding device and on the bottom surface of the drinking vessel, without altering the basic utility and operation of the invention. Other possible arrangements for attaching the drinking vessels to body member 11 include a strap means, a magnetic attraction means, a vacuum or suction cup means, or an O-ring arrangement in which the base of the drinking vessel is secured, although some of such methods are less preferred than others. For example, relatively powerful magnets and opposing magnetic material or magnets could be used in the surface of the body or holding member 11 and drinking vessels 22 in weighing in use these magnetic elements brought close together, so the drinking vessels are temporarily firmly adhered to the surface of the holding member.

Figure 6:
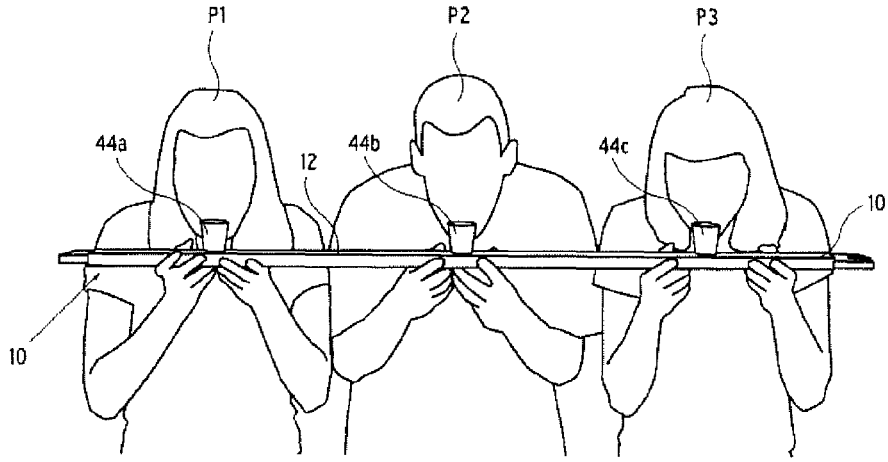
FIG. 6 is a first perspective view illustrating the basic mode of use of the drinking vessel holding device of the present invention.
Figure 7:
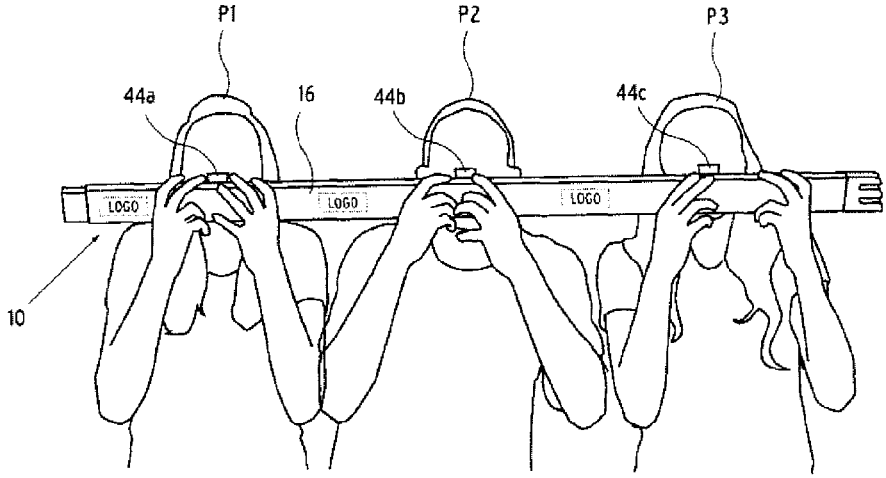
FIG. 7 is a second perspective view illustrating the mode of use of the invention.

FIGS. 6 and 7 illustrate the basic mode of use of a single vessel holding device 10 of the invention. First, the drinking vessels 44*a*-44*c* are filled with a beverage to be consumed, which typically will be an alcoholic beverage such as, for example, a shot of peppermint schnapps or tequila or a glass of beer, although this of course could be any drink. Alternatively, the drinking vessels may first be connected to the holding device 10, and then filled with a beverage to be consumed. The device will preferably either be situated so that it is resting on a relatively flat or horizontal surface when the filled drinking vessels are connected to the holding member, or being held in a horizontal position by the participants P1, P2, and P3 such as shown in FIG. 6. Body member 11 is dimensioned so that the persons to be using the device are comfortably positioned, either sitting or standing, on the same side of the device side-by-side. For example, in FIG. 6, three persons or participants P1, P2, and P3 are shown side-by-side holding device 10 having vessels 44*a*, 44*b*, and 44*c* attached, with participant P1 situated directly in front of vessel 44*a*, participant P2 situated directly in front of vessel 44*b*, and participant P3 situated directly in front of vessel 44*c*. Next, as is also shown in FIG. 6, the participants P1, P2, and P3 will each grasp the device in their hands in any comfortable position, supporting such device while taking care to hold the body member so that the top surface remains substantially horizontal and the vessels are not tipped and the liquid is not spilled. Next, upon the appropriate signal, such participants P1, P2, and P3 will, altogether, lift or move the holding device so that the drinking vessels are more or less directly in front of or just below their mouths, and then, as shown in FIG. 7, usually in the same motion, the device will be tipped or slanted toward such persons so that the liquid in the drinking vessels can be simultaneously consumed. Alternatively, the signal to initiate the lifting and tilting process may occur before the device is lifted off of its support surface. After the contents of vessels 44*a*-44*c* has been consumed, the participants P1-P3 will again lower the body member 11 and presumably rest it back on a support surface. The drinking vessels may then either be refilled and the entire process repeated with either the same or different participants, or the vessels may be removed from the bar member and then, if desired, a new set of vessels may attached to the holding device so that the steps above may be repeated.

While the beverage holding device of the present invention is primarily considered by the present inventor to be a novelty item for increasing the enjoyment and interaction between participants during a social event or the like, such device also comprises a unique advertising tool in that product logos, brand names, slogans and the like may be placed on the top surface 12, side surfaces 14 and 15, bottom surface 16, end surfaces 17 and 18, or even on buckle members 26 and 28 and drinking vessels 44*a*-44*c*. As examples, in FIG. 1 the words "LOGO" and "AD" are shown in dotted lines in several places on both the top and side surfaces of body member 11. Such logos and advertisements will be clearly and easily visible when the device 10 is not being used and is simply resting on a support surface, or when it is being held in the hands of participants such as shown in FIG. 6, when onlookers can see the logos and advertisements on side opposite the participants as well as on the top of the device, while the participants can see the logos and ads on the same side of the device on which they are standing. Furthermore, as shown in FIG. 7, when the device 10 is raised and tilted for beverage consumption by the participants, logos placed on the bottom surface 16 of the device, indicated by the word "LOGO" in dotted lines on such bottom surface, the same or different logos may be visible. Logos or like advertising material may be particularly effective on bottom surface because the view of the lifted holder is likely to be best recalled by observers opposite to the users when the holder is raised, and in addition it is at this time, and from this angle, from which photographs of the festivities of the participants are likely you made.

Placement of logos or brand names for advertising purposes on the surfaces of the device in general has several advantages over normal means of advertising. First, with respect to the participants, the logos will be directly in front of each of them and therefore will be easily within their line of sight, so that the advertising indicia will at a minimum be viewed by each of such participants. Second, the use of the beverage vessel holding device also is quite likely to attract a significant amount of attention by curious onlookers, who will want to see such event, and who may even line up to participate in a future event. At a minimum, however, the advertising on the side surfaces as well as the top and bottom surfaces of the device will be clearly visible to each and every one of such onlookers. Therefore, with respect to its use as an advertising medium, due to the fact that the holding device is placed directly in the line of sight of a large number of participants and onlookers, the overall effect and potential of such device as an advertising medium is greatly enhanced over many traditional or normal advertising systems. Furthermore, when used by a public place, such as a taproom or restaurant, the holder is likely to be stored in plain sight, such as being hung on the wall or the like, where the logos or other advertising will be constantly readily visible and the viewer's eyes will tend to be naturally attracted to the holder because of its status as an implement of celebration, rather than merely an advertising display.

Figure 8:
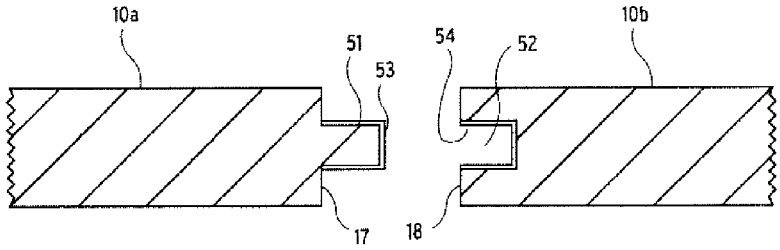
FIG. 8 is a sectional view of an alternative arrangement for temporarily securing two of the holding devices of the invention together via a mortise and tenon connection.

Further improvements or features may be included with the holding device of the invention. For example, the entire device, including the drinking vessels, body member, and means for connecting the body members together end-to-end, could be formed from a single mold, wherein after each use the entire device could be washed either by hand or in a dishwasher and then reused. In addition, one possibly very effective way to combine several of the drink holders for multiple person use may be by a matching mortise and tenon arrangement provided on the ends of such devices. Furthermore, in situations where it may be desired to provide a modicum of flexibility between holders to allow for at least some adjustment between holders and to avoid possible injury to the lips and teeth of the participants or spillage on their clothes, which is likely to be more inherently objectionable to women participants than to male participants, the mortise and tenon attachment for adjacently used holders may be lined with an at least somewhat flexible material. This is illustrated in FIG. 8, a cross section of a portion of two holding devices 10*a* and 10*b* is shown, and where a mortise and tenon interconnection is provided on the ends of the two holding devices of the invention, with holding device 10*a* having a tenon 51 extending outwardly from end 17, and holding device 10*b* having mortise 52 extending inwardly from end 18. Tenon 51 is covered by layer 53, which is preferably a resilient rubber or plastic material. In addition, a layer 54, also preferably a resilient rubber or plastic material, is lining mortise 52. Because the lining material 53 and 54 is a softer and more flexible material than the standard material of the holder, such material will give the connection the ability to flex slightly upon an impact. Of course, the mortise and tenon connection is also another useful arrangement for connecting the holding devices of the invention together even without using such lining or coating of flexible material.

Figure 9:
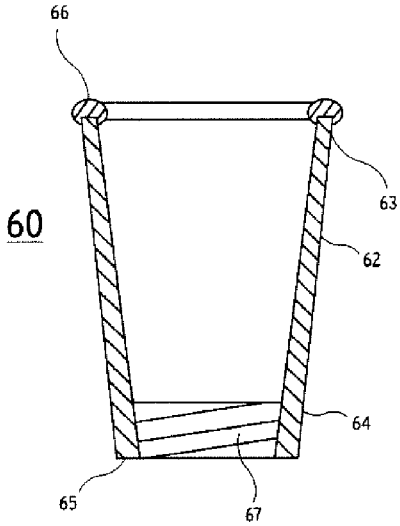
FIG. 9 is a cross-sectional view of an alternative drinking glass for use with the holding device of the invention wherein the rim and threads of the glass are coated with a resilient material.
Figure 10:
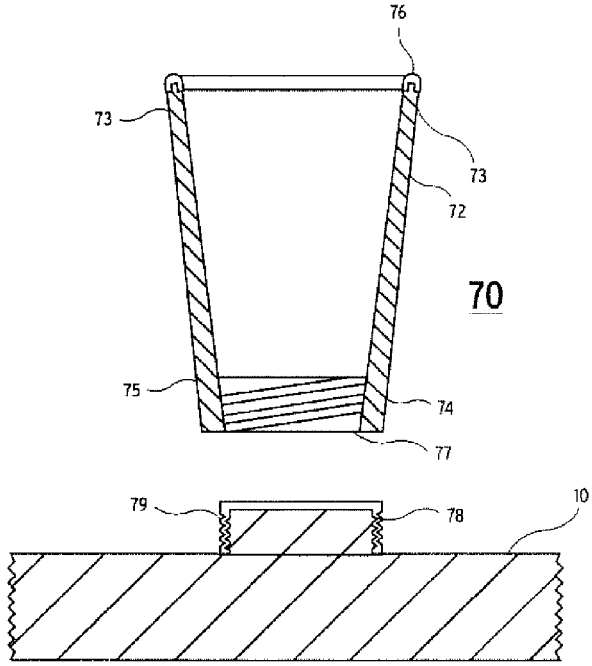
FIG. 10 is a cross-sectional view of another alternative drinking glass for use with the holding device of the invention having an reduced rim section coated with a resilient material, and also wherein the threaded socket in the holding device also may be coated with such a material.

Particularly in today's social climate wherein artificially white and straightened teeth are becoming more and more prevalent, the feminine sex in particular may have some trepidation concerning forcible impact of a glass vessel or the like with the teeth, which seldom happens if one is lifting one's own glass, but may be more likely to occur if another person or a group of persons is controlling the movement of a glass. The danger and/or natural reticence of participants, not to mention the concerns of owners of public establishments where the holders are used not to injure their customers, may be alleviated to a considerable extent by the use of the resilient lining of the tenon and mortise openings, as it allows a modicum of flexibility between the sections, allowing each user to have somewhat better control of their section and tending to dampen the force or movement impacted to the holder by another participant. In addition, an even greater safety factor may be provided by the use of glasses having an upper rim somewhat provided with an at least partially resilient material such as a rubber composition or a clear plastic composition. A clear plastic particularly resilient material may, for example, be placed over or upon the outer rim of the glasses to be used with the holder, i.e., glasses having spiral interlockings on the bottom and the like. Such resilient material may also be applied on a reduced top surface or rim and if clear will not ever be noticeable or may be made as a visible border so that the users realize that special injury resistant glasses are being used. A cross-section of such arrangement is shown in FIGS. 9 and 10. In FIG. 9, a cross section of a safety glass 60 is shown having a reservoir portion 62 with an upper end 63 and a base portion 64 at its bottom end having a threaded socket 65 for attachment to the holding device of the present invention in substantially the same manner as has already been described above with particular reference to FIG. 4. Rim 63 is covered or coated with a resilient plastic material or layer 66, and furthermore a resilient plastic material or layer 67, indicating the stippling on threaded area 65, is provided over such area. In FIG. 10, a slightly alternative embodiment is shown, wherein glass 70 has a reservoir portion 72 with a reduced diameter upper rim area 73, and a bottom portion 74 having at its bottom end a threaded socket 75. Reduced diameter rim 73 is covered by a resilient plastic material or layer 76, while a similar layer 77 is provided over threaded area 75, indicated by the stippling on such threads. In addition, holding device 10 having a threaded knob 78 on which threaded socket 75 is received may also include a layer 79 of such resilient plastic material. The resilient plastic may be secured to the glasses or holders in any usual manner, such as by a heat bonding process or an adhesive. The "safety rim" on the glasses will be found to be a substantial improvement in the overall safety of the device of the invention in avoiding possible damage to drinking participant's teeth. In addition, the threaded engagement of the bottoms of the glasses with the holders may be lined with resilient material either on the surface of the glass or the surface of the holder or both. An unusually safe cooperative drinking arrangement may be provided by using a lined mortise and tenon linking arrangement, resilient covered threads on the holders and glasses, plus a resiliently padded lip on the glasses. If a mortise and tenon arrangement is not desired, a peg type interconnection with separate pegs extending into lined orifices may be provided. Such pegs may be attached to the end of each drinking holder on a decorative chain or cord providing an interesting both decorative and useful appendage.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A device for supporting two or more drinking vessels in a manner that facilitates simultaneous coordinated beverage consumption by two or more participants arranged shoulder to shoulder comprising:

at least one elongated unitary body member having substantially planar top, side, bottom, and end surfaces, a longitudinal length extending from end to end defining a longitudinal axis, and a transverse width;

means associated with said at least one elongated unitary body member for rigidly connecting said at least one elongated unitary body member to at least one other elongated unitary body member with the longitudinal axes of said connected elongated unitary body members being aligned, and with one end surface of said at least one elongated unitary body member in abutment with one end surface of at least one other said elongated unitary body member;

said plurality of receiving members each additionally comprises a threaded socket on the top surface of said at least one elongated unitary body member, additionally comprising at least one drinking vessels, which is securable to the top surface of said at least one elongated unitary body members in one said plurality of threaded sockets, said at least one drinking vessels having a bottom section and an open mouth with a peripheral rim opposite said bottom section and threads matching those in said plurality of threaded sockets on said bottom section a plurality of receiving members formed in said at least one elongated unitary body member, each of said receiving members being positioned adjacent another of said plurality of receiving members, each of said plurality of receiving members being adapted to hold a drinking vessel, each of said plurality of receiving members being positioned in a single row along the longitudinal length of said at least one elongated unitary body member and spaced apart from adjacent receiving members about average shoulder width or wider to allow two or more beverage consumption participants when situated along the same side surface of said at least one elongated unitary body member in a side-by-side relationship to each be oriented directly in front of any of said adjacent receiving members.

2. The device of claim 1 in which said plurality of receiving members each additionally comprises two or more threaded extensions protruding upwardly from the top surface of said at least one elongated unitary body member.

3. The device of claim 2 in which said two or more threaded extensions are at least partially recessed into the top surface of said elongated unitary body member.

4. The device of claim 2 additionally comprising at least one drinking vessel, said at least one drinking vessel having a threaded socket adapted to receive one of said two or more threaded extensions to secure the at least one drinking vessel to said at least one elongated unitary body member.

5. The device of claim 1 in which said means for rigidly connecting said at least one elongated unitary body members to another said at least one elongated unitary body member in longitudinal and end-to-end alignment is comprised of a connector clip positionable between the end surfaces of said connected at least one elongated unitary body members.

6. The device of claim 1 additionally comprising one or more advertising indicia provided on one of the surfaces of said at least one elongated unitary body member.

7. The device of claim 1 in which said means for rigidly connecting said at least elongated unitary body member to another said at least one elongated unitary body member with the longitudinal axes of said elongated unitary body members aligned and with one end surface of said at least one elongated unitary body member connected to one end surface of another said at least one elongated unitary body member comprises a male and female inter-engagement structure on the end surfaces of said at least one elongated unitary body member and another at least one elongated unitary body member.

8. The device of claim 7 in which said inter-engagement structure is comprised of mating mortise and tenon joint sections said mortise and tenon sections being positioned at the ends of said at least one elongated unitary body member, and said mortise and tenon joint sections connected extending outwardly from the ends of said at least one elongated unitary body member.

9. The device of claim 8 additionally comprising a thin lining of a cushioning material provided over the surface of at least one of said mortise and tenon joints sections.

10. The device of claim 7 in which said inter engagement structure additionally comprises a cushioning means situated between the connected end surfaces of said at least one elongated unitary body member and another at least one elongated unitary body member to provide participants with greater control of said connected elongated unitary body members during coordinated beverage consumption.

11. The devise of claim 1 additionally comprising a cushioning material permanently covering at least one of the threads or rim of said at least one drinking vessel to mitigate the force of said rim against a participants mouth and teeth as said at least one elongated unitary body member is lifted to bring said at least one drinking vessel towards a participants mouth during coordinated beverage consumption.

12. The device of claim 1 in which said plurality of receiving members is located on the top surface of said at least one elongated unitary body members.

13. The device of claim 12 in which each of said plurality of receiving members is comprised of a threaded sockets in the top surface of said at least one elongated unitary body member, and additionally comprising a plurality of drinking vessels having an open mouth end with a peripheral rim and an opposite threaded end which threads match those in said plurality of sockets, and additionally comprising a flexible lining at least one of the threads or rim of said plurality of drinking vessels, to prevent damage to the participants teeth and mouth as said at least one elongated unitary body member is moved toward the participants mouth during coordinated beverage consumption.

14. The device of claim 1 additionally comprising at least one drinking vessel, said at least one elongated unitary body member and said at least one drinking vessel being formed integrally using a single molding process.

15. The device of claim 1 in which each receiving member of said plurality of receiving members which is positioned closest to an end surface of said at least one elongated unitary body member is spaced inwardly of said end surfaces about one-half a shoulder width or greater such that when said at least one elongated unitary body members is rigidly connected in longitudinal and end-to-end alignment with another at least one elongated unitary body member, the receiving members closest to the end surfaces of said connected elongated unitary body members are spaced apart about shoulder width or greater.

16. The devise of claim 1 in which each threaded socket on said at least one elongated unitary body member positioned closest to an end surfaces of said at least one elongated unitary body member is spaced from said end surface about one-half a shoulder width or wider so that when said at least one elongated unitary body member is connected in an end-to-end relationship with another at least one elongated unitary body member the threaded sockets closest to the connected end surfaces are spaced apart about shoulder width or greater.

* * * * *